US006926583B2

(12) United States Patent
Nussbaumer et al.

(10) Patent No.: US 6,926,583 B2
(45) Date of Patent: Aug. 9, 2005

(54) GRINDING WHEEL

(75) Inventors: Josef Nussbaumer, Augsburg (DE); Rolf Spangenberg, Gauting (DE); Francois Boland, Gembloux (BE); Jean-Pierre Chevalier, Braine-l'Alleud (BE)

(73) Assignee: Hilti Aktiengesellschaft, Schaan (LI)

( * ) Notice: Subject to any disclaimer, the term of this patent is extended or adjusted under 35 U.S.C. 154(b) by 150 days.

(21) Appl. No.: 10/217,582

(22) Filed: Aug. 12, 2002

(65) Prior Publication Data

US 2003/0054746 A1 Mar. 20, 2003

(30) Foreign Application Priority Data

Aug. 13, 2001 (DE) ..... 101 39 762

(51) Int. Cl.[7] ..... B24B 49/00
(52) U.S. Cl. ..... 451/5; 451/527; 451/529
(58) Field of Search ..... 451/5, 548, 527, 451/529, 599, 461, 544

(56) References Cited

U.S. PATENT DOCUMENTS

| | | | | |
|---|---|---|---|---|
| 3,121,982 A | | 2/1964 | Miller | 51/209 |
| 3,745,719 A | | 7/1973 | Oswald | 51/209 |
| 4,993,891 A | | 2/1991 | Kaminiski et al. | 407/42 |
| 5,782,682 A | | 7/1998 | Han et al. | 451/548 |
| 5,911,620 A | | 6/1999 | Spangenberg et al. | 451/548 |
| 6,196,911 B1 | * | 3/2001 | Preston et al. | 451/548 |
| 6,299,522 B1 | * | 10/2001 | Lee | 451/548 |
| 6,527,634 B2 | * | 3/2003 | Lee et al. | 451/548 |
| 6,551,181 B2 | * | 4/2003 | Lee | 451/548 |

FOREIGN PATENT DOCUMENTS

| | | |
|---|---|---|
| EP | 0535431 | 4/1994 |

* cited by examiner

*Primary Examiner*—Joseph J. Hail, III
*Assistant Examiner*—Alvin J Grant
(74) *Attorney, Agent, or Firm*—Sidley Austin Brown & Wood, LLP

(57) ABSTRACT

A grinding wheel including a circular grinding region (1) with a plurality of through-openings (3) formed therein, a central mounting region (2) coaxial with the grinding region (1), and a plurality of cutting bodies (4) having a rectangular base surface, projecting from the grinding region (1), and spaced from a center of the mounting region (2) by different radial distances, with each cutting body (4) having a longitudinal side (5) adjacent to the center of the mounting region (2) and a wide side (6) remote from the center of the mounting region (2), with the longitudinal side (5) and the wide side (6) forming together an edge (K), and with the longitudinal side (5) extending at an angle (B) of from 35° to 55° to a radial line (R) extending from the center of the mounting region (2) and passing tangentially to the edge (K).

8 Claims, 2 Drawing Sheets

GRINDING WHEEL

BACKGROUND OF THE INVENTION

1. Field of the Invention

The present invention relates to a grinding wheel including a circular grinding region with a plurality of through-opening formed therein, a central mounting region coaxial with the grinding region, and a plurality of cutting bodies having a rectangular base surface, projecting from the grinding region, and spaced from the center of the mounting region by different radial distances.

2. Description of the Prior Art

For treating, e.g., coated surfaces of mineral constructional component, tools such as milling discs, which are provided with segment-shaped hard metal elements, are used. The drawback of such a tool consists in that no selfsharpening of the hard metal elements takes place. Therefore, the output of the tool becomes rapidly reduced during the service life of the tool.

Also, are used grinding wheels equipped with diamond-containing cutting bodies which are particularly suitable for treating coated mineral constructional components and which are primarily designed to this end. U.S. Pat. No. 3,745,719 discloses such grinding wheel. The known grinding wheel has a circular grinding region, a plurality of through-openings formed in the grinding region, a central mounting region coaxial with the grinding region, and a plurality of cutting bodies having a rectangular base surface, projecting from the grinding region, and spaced from center of the mounting region by different radial distances. Because of the arrangement, in the known grinding wheel, of the cutting bodies so that their wide side or longitudinal side extends parallel to a radial line extending from the center of the mounting region, a flat cutting of the coating of a constructional component takes place; i.e., the cutting is effected either with the wide side or with the longitudinal side of the cutting body. Such cutting results in a poor penetration behavior of the cutting body with respect to the coating and leads to an increased heating of the coating which is caused by friction between the coating and the rotatable cutting body. The increased heating leads to weakening of the coating and to adhesion of the removable material to the cutting body which leads to worsening of the penetration behavior of the cutting body with respect to the coating.

Accordingly, an object of the present invention is to provide a grinding wheel the cutting bodies of which will cut the coating in a wedge-like manner and which can be economically produced.

Another object of the present invention is to provide a grinding wheel provided with sharp, self-sharpening cutting edges.

SUMMARY OF THE INVENTION

These and other objects of the present invention, which will become apparent hereinafter, are achieved by providing a grinding wheel in which each cutting body has a longitudinal side adjacent to the center of the mounting region and a wide side remote from the center of the mounting region, with the adjacent longitudinal side and the remote wide side forming together an edge, and with the adjacent longitudinal side extending at an angle of from 35° to 55° to a radial line extending from the center of the mounting region and passing tangentially to the edge.

The arrangement of the cutting bodies according to the present invention permits the achievement of a wedge-like removal of the coating material. The wedge-like penetration of the cutting bodies into the coating insures a more rapid removal of the coating material from a constructional component, without the coating being heated and without the coating material sticking to the cutting bodies. A particularly high output is achieved when the longitudinal side forms with the radial line an angle of about 45°. Moreover, the good penetration behavior of the cutting bodies with respect to the coating results in smooth running of the grinding operation.

Advantageously, each cutting body has two matrix zones having different concentration of diamonds and arranged one after another in a direction parallel to the remote wide side of the cutting body. The matrix zone with a high concentration of diamonds serves for removing of the coating, while the matrix zone with a smaller diamond concentration performs a supporting function, as a support back face.

In order to be able to remove the coating with a sharp cutting edge that extends along the longitudinal side adjacent to the center of the mounting region and along the free end of the cutting body, preferably, the first matrix zone, which is located adjacent to the center of the mounting region has a greater concentration of diamonds than the second matrix zone remote from the center of the mounting region.

Advantageously, the grain size of the diamonds in the first matrix zone is smaller than the grain size of diamonds in the second matrix zone. This leads to a different wear of the diamonds during a grinding operation. In the first matrix zone, the diamonds do not break out as rapidly as in the second matrix zone. Even when the diamonds of the first matrix zone break out, this does not result in a non-sharp edge because of the small size of the grains in the first matrix zone. Because of their comparatively large size, the diamonds in the second matrix zone break out more rapidly than in the first matrix zone. Therefore, a greater wear of the support back face which is built-up during the grinding operation, takes place. Thereby, the cutting edge of the cutting body assures a certain "free position".

For manufacturing reasons, a width of the first matrix zone with a greater diamond concentration, which is measured in the direction parallel to the wide side of the cutting body corresponds to from 0.15 to 0.35 of a width of the cutting body.

In order to insure that grinding is effected with the entire grinding region, the grinding region is formed of a plurality of radially offset, at least partially overlapping each other, coaxially arranged circular surfaces, with at least one cutting body being located in each of the circular surfaces. The grinding output is increased when the cutting bodies are inclined toward the plane of the grinding wheel. The inclination of the cutting bodies to the grinding wheel plane facilitates removal of the material because the removable material contacts not a perpendicular surface but rather an inclined surface of the cutting body and is separated from the constructional component at a so-called effective cutting angle. The inclined surface is formed by the longitudinal side of the cutting body which extends to the plane of the grinding wheel, which is defined by the plane of the grinding region, at an angle from 80° to 90°. With the inclination angle of 80°–90°, an effective cutting angle, which is formed between the longitudinal side and perpendicular to the grinding wheel plane, of from 10° to 20° is obtained. It is particularly advantageous when the effective cutting angle amounts to 15°.

Good removal of the coating material from the cutting region is effected through openings formed in the grinding region of the grinding wheel. Advantageously, a through-opening is provided in a circumferential region of each cutting body opposite the cutting edge of the cutting body. The advantage of such an arrangement of the through-openings of the grinding region consists in that the coating material can be removed immediately after cutting by a cutting body, e.g., by using a suitable suction device that would aspirate the material from the operational region.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
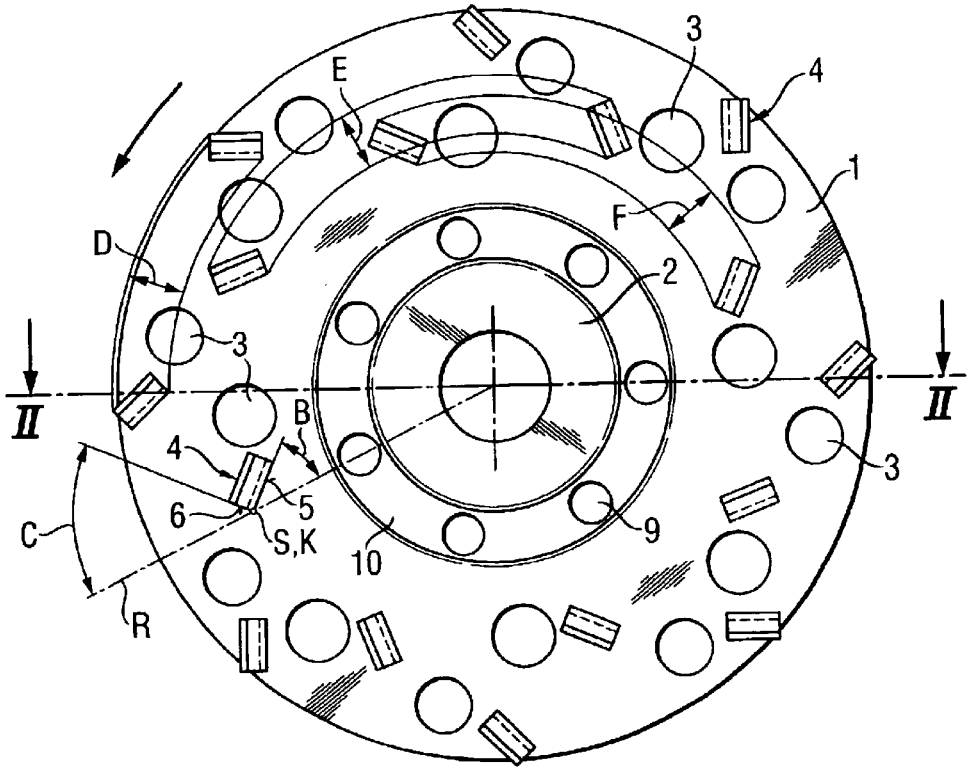
FIG. 1 a bottom view of a grinding wheel according to the present invention.
Figure 2:
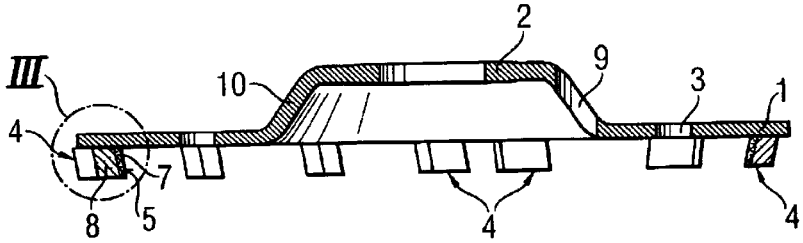
FIG. 2 a cross-sectional view of the grinding wheel along line II—II in FIG. 1, and FIG. 3 a cross-sectional view of a portion III of the grinding wheel as shown in FIG. 2 at an increased scale.
Figure 3:
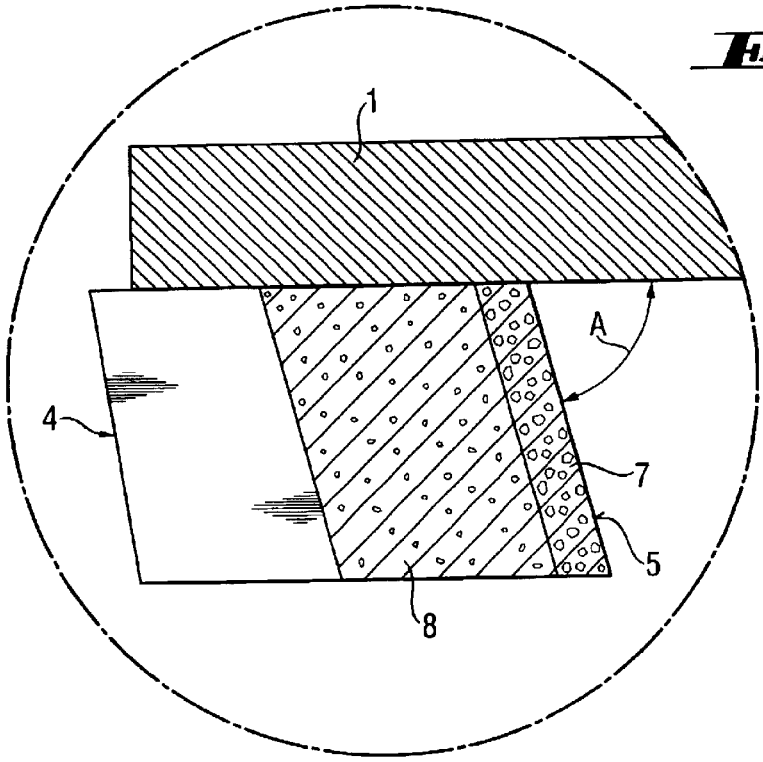

A grinding wheel according to the present invention, which is shown in FIGS. 1–3, is designed for removal of a coating from a mineral constructional component. FIGS. 1–3 show neither the mineral constructional component nor the coating. The inventive grinding wheel has a grinding region 1, a mounting region 2 located adjacent to the grinding region 1, a plurality of through-openings 3 formed in the grinding region 1, and a plurality of cutting bodies 4 which have a rectangular base surface and which project from the grinding region 1. The grinding region 1 and the central mounting region 2 are arranged coaxially with each other but are spaced from each other in a direction parallel to the common central axis of both regions 1 and 2. The transition region 10 between the grinding region 1 and the mounting region 2 has a conical profile. A plurality of through-openings 9 is formed in the transition region 10.

The grinding region 1 is formed of a plurality of radially offset relative to each other, partially overlapping each other, circular surfaces D, E, F. In each of the circular surfaces D, E, F, there are provided four or eight cutting bodies 4 uniformly distributed along a circumference of a respective circular surface D, E, F. In view of the above, the cutting bodies 4 are spaced from the central mounting region 2 by different distances. The eight cutting bodies 4 are provided in the circular surface D which is spaced from the central mounting region 2 by a largest distance. Of the circular surfaces D, E, F, only surfaces E and F overlap each other in the radial direction.

A longitudinal side 5 of each cutting body adjacent to the center of the mounting region 2, extends at an angle B of 45° to a radial line R extending from the center of the mounting region 2. The radial line R passes through an intersection point S of the longitudinal side 5 with the wide side 6 of the cutting body 4 remote from the center of the mounting region 2.

Each cutting body 4 has two matrix zones 7 and 8 having different concentration of diamonds. The matrix zones 7 and 8 are arranged one behind the other in a direction parallel to the wide side 6 of the cutting body 4. The matrix zone 7, which is located closer to the center of the mounting region 2, has a larger concentration of diamonds than the matrix zone 8 remote from the center of the mounting region 2. The diamonds of the two matrix zones 7 and 8 have, respectively, different grain sizes. Thus, the diamonds in the first matrix zone 7 have a smaller grain size than the diamonds in the second matrix zone 8. The width of the matrix zone 7 measured in a direction parallel to the wide side 6 of the cutting body 4, corresponds to one-fourth of the width of the cutting body 4. Each cutting body 4 is inclined to the plane of the grinding wheel, with the longitudinal side 5 of the cutting body 4 adjacent to the center of the mounting region 2 being inclined to the plane of the grinding wheel at an angle A of 85°.

The longitudinal side 5 adjacent to the center of the mounting region 2 and the wide side 6 remote from the center of the mounting region 2 form a common edge K. In a circumferential region of each cutting body 4 opposite the edge K, there is located a through-opening 3 through which the removed coating material can be aspirated, e.g., by a suction device (not shown).

Though the present invention was shown and described with references to the preferred embodiment, such is merely illustrative of the present invention and is not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A grinding wheel for removing a coating material from coated surfaces of constructional components, the grinding wheel comprising a circular grinding region (1) having a plane coincident with the surface thereof; a plurality. of through-openings (3) formed in the grinding region (1); a central mounting region (2) coaxial with the grinding region (1); and a plurality of cutting bodies (4) having a rectangular base surface, projecting from the grinding region (1), and spaced from a center of the mounting region (2) by different radial distances, each cutting body (4) being perpendicularly disposed to the plane of the grinding wheel and the cutting face of said cutting bodies each inclined to form an effective. cutting angle (A) therewith and having a longitudinal side (5) adjacent to the center of the mounting region (2) and a wide side (6) remote from the center of the mounting region (2), the adjacent longitudinal side (5) and the remote wide side (6) forming together a cutting edge (K) for wedge-cutting of the coated material, and the adjacent longitudinal side (5) extending at an angle (B) of from 35° to 55° to a radial line (R) extending from the center of the mounting region (2) and passing tangentially to the edge (K).

2. A grinding wheel according to claim 1, wherein each cutting body (4) has two matrix zones (7,8) having different concentration of diamonds and arranged one after another in a direction parallel to the remote wide side (6) of the cutting body (4).

3. A grinding wheel according to claim 1, wherein a first one (7) of the two matrix zone (7, 8), which is located adjacent to the center of the mounting region (2) has a greater concentration of diamonds than a second one (8) of the two matrix zones (7, 8) remote from the center of the mounting region (2).

4. A grinding wheel according to claim 3, wherein diamonds of the first one of matrix zones (7,8) have a smaller grain size than diamonds of the second one of the matrix zones.

5. A grinding wheel according to claim 3, wherein a width of the first one (7) of the two matrix zones (7,8), measured in the direction parallel to the wide side (6) of the cutting body (4) corresponds to from 0.15 to 0.35 of a width of the cutting body (4).

6. A grinding wheel according to claim 1, wherein the grinding region (1) is formed of a plurality of radially offset, at least partially overlapping each other, coaxially arranged circular surfaces (D, E, F) with at least one cutting body (4) being located in each of the circular surfaces (D, E, F).

7. A grinding wheel according to claim 1, wherein the longitudinal side (5) of the cutting body (4) extends at an angle (A) from 80° to 90° to the plane of the grinding wheel.

8. A grinding wheel according to claim 1, wherein in a circumferential region of each cutting body (4) opposite the edge (K) thereof, a through-opening (3) is located.

* * * * *